United States Patent [19]

Levinson

[11] Patent Number: 4,540,169

[45] Date of Patent: Sep. 10, 1985

[54] CASSETTE SHEET FEED APPARATUS

[75] Inventor: Leo Levinson, Berkeley, Calif.

[73] Assignee: Xerox Corporation, Stamford, Conn.

[21] Appl. No.: 538,594

[22] Filed: Oct. 3, 1983

[51] Int. Cl.[3] ..... B65H 1/22

[52] U.S. Cl. ..... 271/127; 271/164

[58] Field of Search ..... 271/162, 164, 126, 127

[56] References Cited

U.S. PATENT DOCUMENTS

| | | | |
|---|---|---|---|
| 4,221,375 | 9/1980 | Morrison | 271/162 X |
| 4,387,889 | 6/1983 | Koyama | 271/162 X |
| 4,402,498 | 9/1983 | Suzuki | 271/164 |

FOREIGN PATENT DOCUMENTS 2114104 8/1983 United Kingdom .

*Primary Examiner*—Richard A. Schacher

*Attorney, Agent, or Firm*—Serge Abend

[57] ABSTRACT

An improved sheet feeding apparatus for use in printers, typewriters, facsimile equipment and copying machines. The apparatus comprises a cassette loading system wherein the cassette may be automatically loaded into operative position, and locked therein, in a sequence of two substantially transverse movements which prevent sheet misfeed and require a minimum of operator activity.

11 Claims, 6 Drawing Figures

CASSETTE SHEET FEED APPARATUS

This invention relates to an improved sheet feeding arrangement for use in printers, typewriters, facsimile equipment and copying machines. More particularly, it is directed to a cassette loading system wherein the cassette may be automatically loaded into operative position, and locked therein, in a sequence of movements which prevent sheet misfeed and require a minimum of operator activity.

Automatic sheet feeding systems have long been in use with the utilization devices set forth above. These include sheet supply trays operatively coupled with a sheet removal and delivery system for serially feeding a single sheet at a time to an information transfer station. The removal and delivery system normally includes a stripping device, such as a roller or pair of rollers, snubbers or retard members, which insure that only a single sheet is fed from the stack, and a transport train, for moving the sheet. In order to effect sheet loading and unloading it is common to provide a suitable mechanism for decoupling and moving the sheet supply tray from the sheet removal mechanism, load the tray with a stack of sheets, and then return the tray to its operative position. For this reason, sheet feeders are often bulky, mechanically complex and expensive. Additionally, from the viewpoint of the machine operator, it is a time consuming operation to change sheets, as is required when it is desired to change the size, color, format, or other sheet characteristic.

In printers and typewriters. however, the manual approach has been the usual practice. A notable exception has been computer output printing where the continuous fan-fold perforated sheet has been used. While this is satisfactory for some applications, it requires a special paper which is not ordinarily suited to many requirements for which normal typewriting is employed (e.g., the business letter). With recent improvements in word processing equipment (e.g., memory typewriters and personal computer systems with peripheral printers) the output speed of the information generator has substantially increased, to the point where the rate at which the hard copy output sheet can be brought to and moved past a printing head becomes the bottleneck of the system. Therefore, automatic sheet feeding systems have been found to be extremely useful and are more frequently integrated into typing and printing sytems. These systems must be fast and reliable and, hopefully, inexpensive and simple to use.

Another known automatic sheet feeding approach requires that a stack of sheets be shingled in the supply tray and that the exposed top- or bottom-most sheet be separated therefrom and transported. This is usually accomplished by manually loading a stack in such a way as to allow several sheets to enter the nip between a feed roller and a retard roller.

By far the simplest sheet feeding approach for the operator is that of providing a cassette into which sheets of a given characteristic are loaded for delivery to the machine. A suitable mechanism will then be incorporated in the machine for reliably loading and removing the cassette. When loading a cassette, two motions must be executed and kept separate from one another in order to avoid misfeed of the sheet contacting the feeding device. These are the motion in a first direction imparted to the cassette as it is introduced into the machine and the subsequent motion in a substantially transverse direction imparted to the cassette for bringing the sheet stack into contact with the feeding device. If it is attempted to combine these motions, as is often done, there is a distinct possibility that the feeding device will misfeed.

Therefore, it is the primary object of the present invention to provide a cassette loading system whereby insertion and removal of the cassette involves movement of the cassette in two sequential substantially transverse directions.

Additionally, it is an object of this invention to provide a sheet feed cassette loading system wherein the cassette may be moved by the operator in one direction on insertion and on removal, and that the operator's action will automatically and sequentially impart both motions to the cassette.

A further object of the present invention is to provide a sheet feed cassette loading system which is simple and inexpensive to manufacture, assemble and service.

The sheet feed apparatus of the present invention may be carried out, in one form, by providing, in a utilization device having internal support members and sheet removing means, a stack of sheets contained within a receptacle. The receptacle is movable into and out of the utilization device in a first direction and is movable toward and away from said sheet removing means in a second direction, and is guided for those movements by guide means on the support members. Slider means on the receptacle interact with the guide means to define the direction of movement of said receptacle. Cam means are associated with the guide means for urging the slider means in the first and second directions, whereby as the slider means moves within the guide means the cam means initially urges the slider means in the first direction and subsequently urges the slider means in the second direction to lock the receptacle in place within the utilization device and to move the receptacle so that the sheet removing means is in driving contact with the sheets in the stack.

The foregoing and other objects and advantages of the present invention will become apparent from the following, more particular, description of a preferred embodiment as illustrated in the accompanying drawings, wherein.

Figure 1:
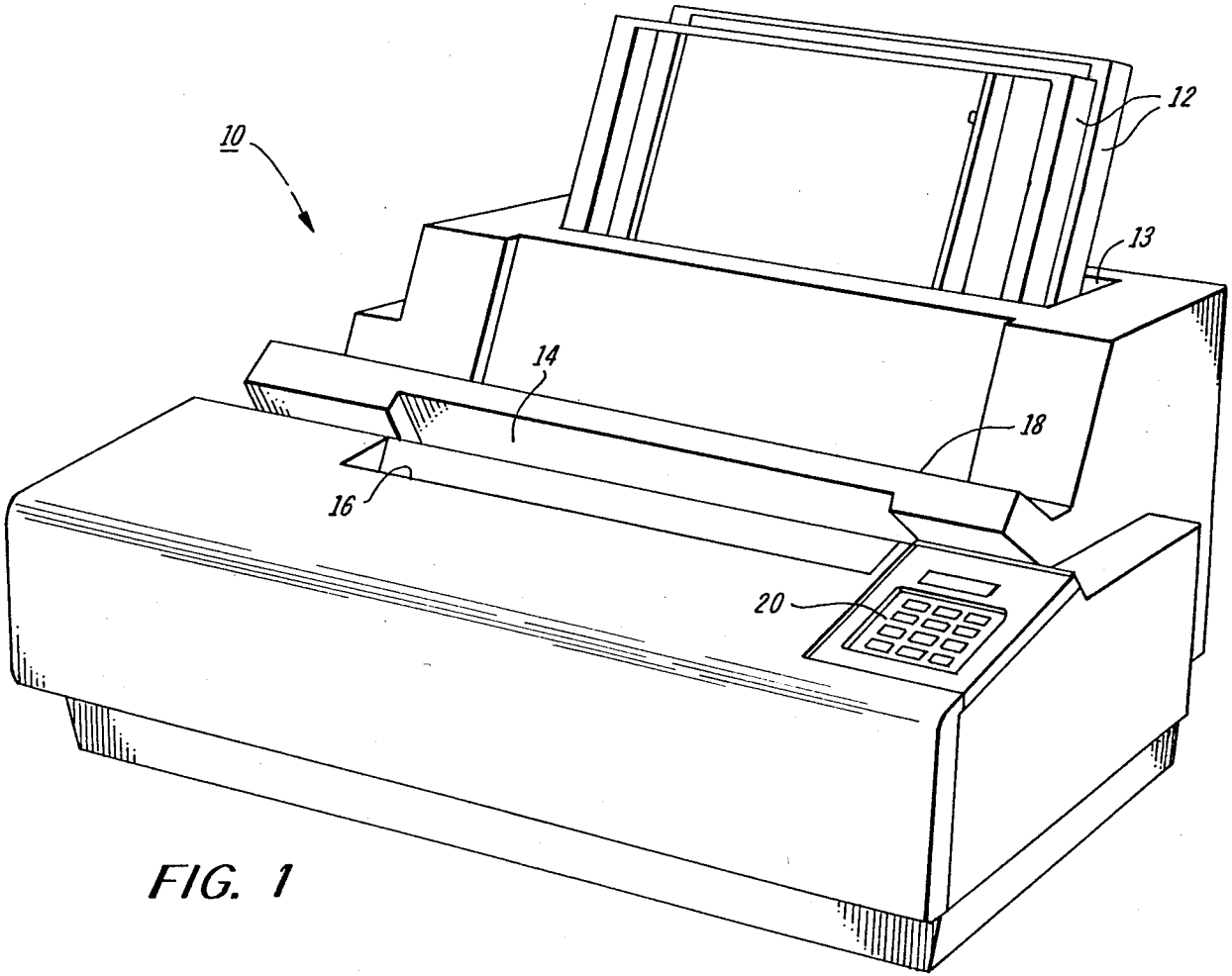
FIG. 1 is a perspective view showing two sheet feeding cassettes loaded in a printer.

With particular reference to the drawings, there is illustrated in FIG. 1 a printer 10 with two sheet cassettes 12. One, for example, could contain a stack of letterhead sheets and the other could contain a stack of plain sheets, for delivery to the printing mechanism. It should be kept in mind that although the present invention is being shown and described in the context of a printer, this is only done by way of example and that the present invention finds equal acceptance in any other utilization device in which a stack of sheets must be automatically delivered seriatim, on demand.

The printer operator will insert the desired type and size of sheet material into each cassette 10 and then place each cassette into the printer by simply sliding it into appropriate slot 13. The loading mechanism, to be fully described, will automatically direct the cassette into and lock it in its operative position. From its operative position, sheets may fed one at a time past the marking mechanism and out of the printer through exit slot 14. A window 16 enables the operator to view the printed line. As an alternative to the automatic sheet feed capability, the printer 10 also includes a delivery slot 18 into which single sheets may be introduced manually, if desired. Control panel 20 enables the operator to command various printer functions and to receive information therefrom, such as instructions and diagnostics.

Figure 2:
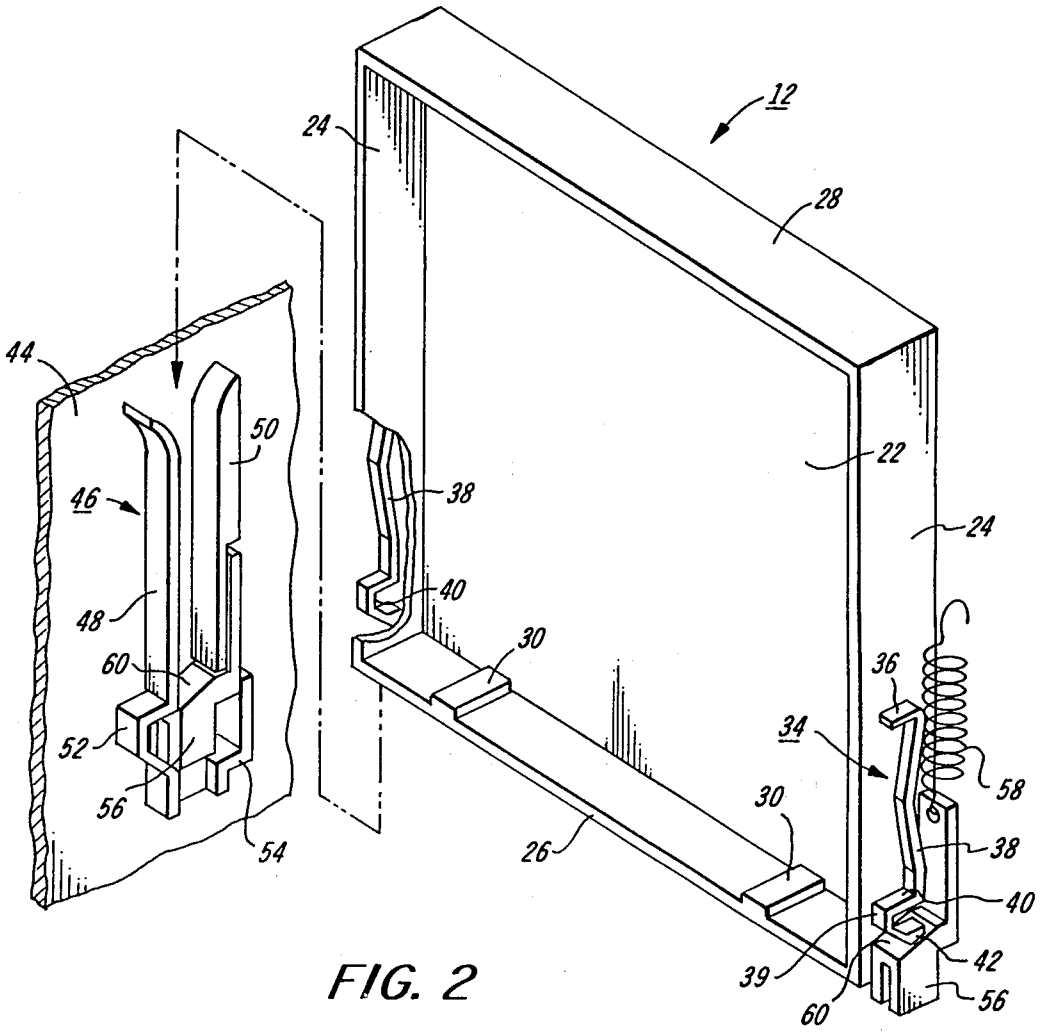
FIG. 2 is a perspective view showing the improved cassette of the present invention relative to the loading and locking mechanism of the printer.

Turning to FIG. 2, the cassette 12 is in the form of a box having a bottom wall 22, side walls 24, end walls 26 and 28, and an open top. A pair of raised sheet support pads formations 30 protrude into the box on end wall 26, to provide a small area sliding surface upon which a stack of sheets may be supported when disposed in their normal, substantially vertical, position. Adjacent the bottom wall 22 is a pivotable sheet support plate 32 (shown in FIG. 3) biased and away from the bottom wall, and into the box by a suitable spring (not shown), for urging the stack toward the sheet feeding device. Conventional sheet retention members, such as corner snubbers (not shown), are usually provided adjacent end wall 26 for inhibiting a simultaneous plural sheet feed.

Slider formations 34 on the exterior of side walls 24 may be integrally formed with the cassette or may be suitably secured thereto. Each slider formation comprises a pivot section 36 at one end, a central rigidifying bridge section 38, and a locking and driving section 39 at its other end. Section 39 includes a pawl 40 and cam follower 42.

Within the printer 10, on either side of the cassette slot 13, are disposed spaced support plates 44, upon which slider guide formations 46 (only one shown in FIG. 2) may be integrally formed, or may be secured thereon. The slider guide 46 is in the form of a channel defined by guide walls 48 and 50, which are spaced from one another sufficiently for receiving slider 34 therebetween. At the entrance end of the guide channel, the walls 48 and 50 are flared outwardly in order to facilitate acceptance of the slider formation 34. Adjacent the opposite end of the guide channel, in guide wall 48, there is formed a notch 52, and in guide wall 50 there is a spaced retaining section 54 for spring loaded cam 56. The cam 56 is biased toward the entrance end of the guide channel by spring 58, one end of which is connected thereto and the other end to the wall 50, and is capable of sliding movement within the guide channel 46. The active camming surface 60, of element 56, is its upwardly facing sloping wall extending between the channel walls 48 and 50.

Figure 6:
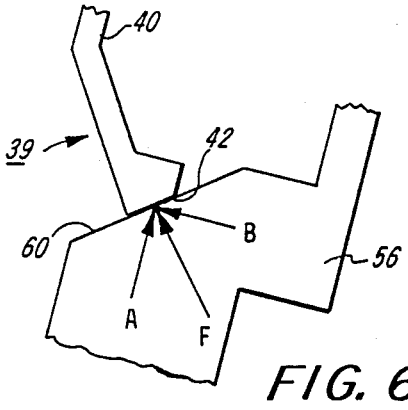
FIG. 6 is a schematic view showing the forces which act to impart the several operative motions to the improved cassette.

As each slider formation 34 moves within its respective slider guide 46, its cam follower 42 will contact and subsequently slide along the active camming surface 60 of the spring loaded cam 56. The forces generated by this interaction are illustrated schematically in FIG. 6. Although there will be a force couple at the contacting surfaces, only the upward forces of the couple, i.e. those acting on the slider, are shown. Normal force F, is perpendicular to the active surfaces, and comprises upward component A and sideward component B.

Figure 3:
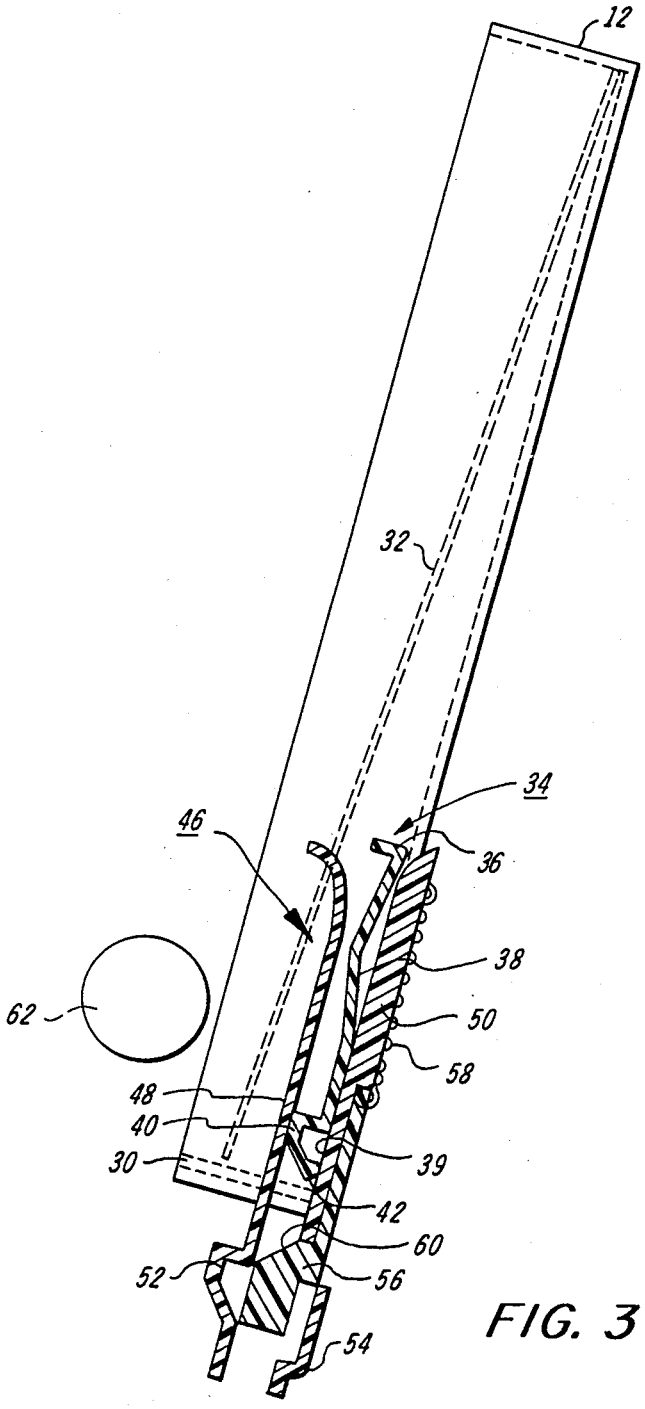
FIG. 3 is a side elevation view of the improved cassette, relative to a feed roller, with a section taken through the loading and locking mechanism during initial introduction of the cassette into the printer.
Figure 4:
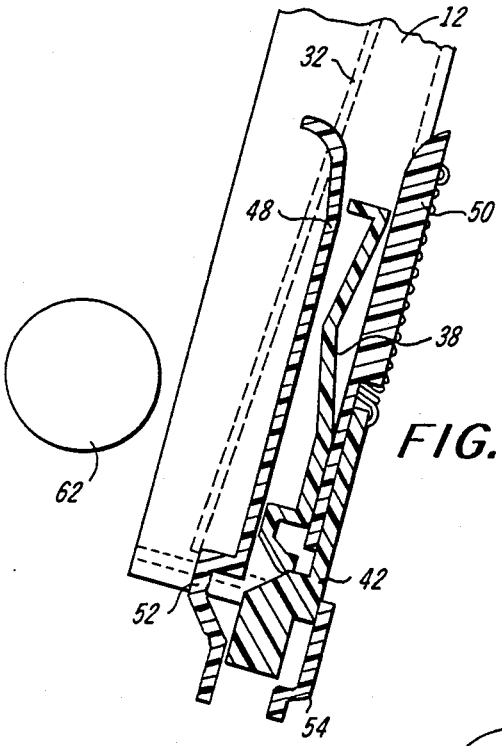
FIG. 4 is a partial side elevation view similar to FIG. 3 showing the cassette in a further stage of insertion into the printer.
Figure 5:
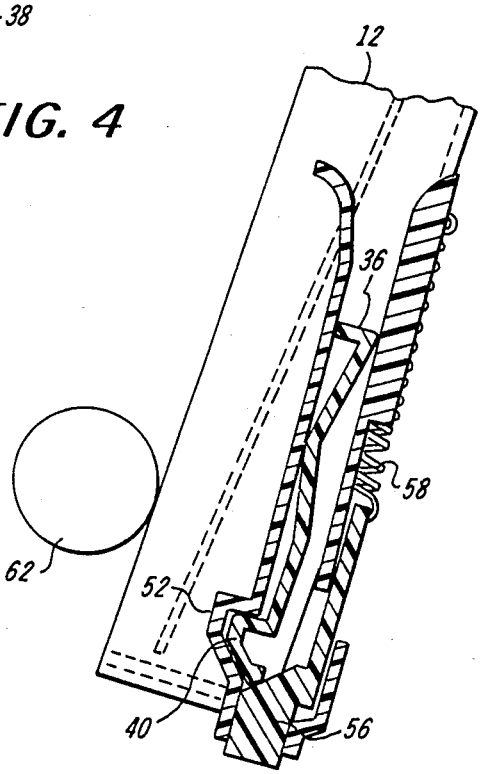
FIG. 5 is another partial side elevation view similar to FIG. 3 showing the cassette in its fully loaded, locked position.

Turning now to the sequence shown in FIGS. 3, 4 and 5, it will be seen that the cassette may be loaded by the operator with only a single vertical motion. Although the orientation shown and described is substantially vertical, it should be understood that the invention may be practiced in the substantially horizontal plane as well. Such a modification of orientation will not benefit from the gravity assist and will require reengineering of some of the parameters of operation, such as spring rates relative friction coefficients of the sliding contact materials and angles of the camming surfaces.

To load the cassette 12 into the printer 10, the locking and driving section 39 of slider formations 34 are started into the slider guide channels 46. The flared entrance section facilitates entry and proper redirecting of the cassette, if the operator loads the cassette somewhat out of alignment. As the cassette is lowered vertically into the printer it is properly aligned between the guide walls 48 and 50 as the slider formation 34 is fully disposed between the channel walls, as illustrated in FIG. 3. Continued lowering causes the cam followers 42 to contact the active camming surfaces 60 of the spring biased cams 56 and to drive the cams 56 downwardly against the upward bias of springs 58 (note FIG. 4). Sufficient force is needed to overcome force component A. It should be noted that during its vertical travel, as illustrated in the FIGS. 3 and 4 positions, the cassette is separated from the feed roller 62.

At the same time, force component B urges the pawl 40 against guide wall 48. Finally, the pawl 40 will be driven downwardly to a location opposite notch 52. At that point, the pawl will be forced into the notch by force component B, as the cam follower 42 slides along the camming surface 60, and the slider will swing about pivot section 36. Force component A now drives the pawl against the upper wall of the notch, locking it in place. This movement also results in the stack of sheets being biased against feed roller 62 (note FIG. 5). Spring 58 must be selected so as to insure that there is also enough locking force to overcome the backup springs behind support plate 32 within the cassette. Thus, it can be seen that two discrete sequential motions take place, the first locating the cassette vertically relative to the feed roller, and the second driving the cassette horizontally against the feed roller. In this manner, there can be no sheet misfeed attributed to relative sliding of the topmost sheet relative to the feed roller.

The advantages derived from the present invention also include simplicity of cassette removal. In order to remove the cassette, the operator merely tilts it toward the front of the printer. This motion causes the slider 34 to rotate about pivot section 36 and releases the pawl 40 from the notch 52, enabling force component A, transmitted by the spring biased cam 56 to the cam follower 40, to drive the cassette vertically upward. Then the cassette may be easily lifted from the printer by the operator.

A further advantage of this loading system is its shock absorbing ability. It is not necessary for the operator to carefully guide the cassette into the printer. When loaded with paper, it may be aligned with the slot 13 and then dropped into the printer without adverely affecting the printer. The springs 58 will absorb the impact and lock the cassette in place, ready for sheet feeding, i.e., the topmost sheet is brought up against the feed roller with the roller properly compressed and ready to feed.

It should be understood that the present disclosure has been made only by way of example and that numerous changes in details of construction and the combination and arrangement of parts may be resorted to without departing from the true spirit and the scope of the invention as hereinafter claimed.

What is claimed is:

1. Sheet feed apparatus for feeding sheets from a stack to a utilization device having internal support members and sheet removing means, wherein the stack of sheets is contained within a receptacle movable in a first direction into and out of said utilization device and movable in a second direction toward and away from said sheet removing means, the improvement being characterized by including slider means on opposite side walls of said receptacle, guide means on said support members, for receiving said slider means and for controlling the direction of movement of said receptacle, and reciprocable cam means supported by said guide means, said cam means having a cam surface for simultaneously urging said slider means in said first and second directions, whereby as said slider means moves within said guide means said cam means initially urges said slider means out of said utilization device in said first direction and subsequently urges said slider means in said second direction to lock said receptacle in place within said utilization device and to move said receptacle so that said sheet removing means is in driving contact with the sheets in said stack.

2. The sheet feed apparatus as defined in claim 1 characterized in that said first and second directions are substantially normal to one another.

3. The sheet feed apparatus as defined in claim 1 characterized by including biasing means acting upon said cam means for urging said cam means in said first direction out of said utilization device.

4. The sheet feed apparatus as defined in claim 3 characterized in that said biasing means comprises a spring having one end connected to said cam means and the other end connected to said guide means.

5. The sheet feed apparatus as defined in claim 3 characterized in that said slider means includes latch means and cam follower means, said guide means includes locking means for interacting with said latch means, and said cam surface interacts with said cam follower means.

6. The sheet feed apparatus as defined in claim 3 characterized in that said slider means comprises formations protruding outwardly from the sides of said receptacle, and said guide means comprises channel formations on said internal support members for receiving said slider formations and said cam means.

7. The sheet feed apparatus as defined in claim 5 characterized in that said slider means comprises formations protruding outwardly from the sides of said receptacle, and said guide means comprises channel formations on said internal support members for receiving said slider formations and said cam means.

8. The sheet feed apparatus as defined in claim 5 characterized in that said receptacle is locked within said utilization device when said latch means is caused to enter said locking means.

9. The sheet feed apparatus as defined in claim 5 characterized in that said said cam follower means includes a second cam surface parallel to said cam surface and both cam surfaces are disposed at an angle to said first and second directions, whereby when said cam surfaces are in biased contact with one another there will exist a first force component in said first direction and a second force component in said second direction.

10. The sheet feed apparatus as defined in claim 9 characterized in that said cam surfaces comprise a low friction material.

11. The sheet feed apparatus as defined in claim 5 characterized in that said slider means further includes pivot means which interacts with said channel formations to form a fulcrum about which said receptacle rotates as it moves in said second direction toward and away from said sheet removing means.

* * * * *